US005456417A

United States Patent [19]

Küsters

[11] Patent Number: 5,456,417

[45] Date of Patent: Oct. 10, 1995

[54] YARN TRAVERSING DRUM FOR A YARN WINDING DEVICE

[75] Inventor: Gerard Küsters, Selfkant-Havert, Germany

[73] Assignee: W. Schlafhorst AG & Co., Moenchengladbach, Germany

[21] Appl. No.: 149,977

[22] Filed: Nov. 10, 1993

[30] Foreign Application Priority Data

Nov. 10, 1992 [DE] Germany ..... 42 37 860.5

[51] Int. Cl.[6] ..... B65H 54/48; B65H 59/00

[52] U.S. Cl. ..... 242/43.2; 242/18 DD; 242/27; 242/31

[58] Field of Search ..... 242/18 DD, 43.2, 242/27, 31

[56] References Cited

U.S. PATENT DOCUMENTS 3,227,385 1/1966 O'Brien ..... 242/43.2

FOREIGN PATENT DOCUMENTS 20293 11/1960 Germany .

1560405 8/1969 Germany .

3026278 1/1981 Germany .

4010471A1 10/1991 Germany .

*Primary Examiner*—Daniel P. Stodola

*Assistant Examiner*—William Stryjewski

*Attorney, Agent, or Firm*—W. Schlafhorst AG & Co.

[57] ABSTRACT

A yarn traversing drum for a textile winder having helical yarn traversing guide grooves forming a central intersection at the longitudinal centerline of the drum. One of the grooves has a smaller angle of inclination, between 10° and 15° and preferably approximately 14° , than the angle of inclination, between 16° and 20° and preferably approximately 17°, of the other groove. The groove having the smaller angle of inclination is shallower and is formed with a wide yarn-capturing pocket adjacent the central intersection in the direction of yarn guiding. The groove having the greater angle of inclination at the central intersection has a beveled edge intersecting the yarn-capturing pocket of the other groove. The difference in angles of inclination results in the yarn reversing ends of the grooves adjacent opposite ends of the drum being offset circumferentially approximately 90°.

10 Claims, 3 Drawing Sheets

YARN TRAVERSING DRUM FOR A YARN WINDING DEVICE

FIELD OF THE INVENTION

The present invention relates to a yarn traversing drum for a textile winder having helical yarn guiding grooves in the surface thereof, and more particularly to a yarn traversing drum having grooves specially configured to retain the yarn in the grooves across groove intersections.

BACKGROUND OF THE INVENTION

Yarn traversing drums for textile winders having helical yarn guiding grooves are generally old and well known. Such drums support and frictionally drive packages being wound thereon to form cross-wound yarn packages. Automatic winders are capable of operating at winding speeds of as much as 1,500 meters per minute. At these high winding speeds, there is a risk of the guided yarn escaping from the traversing grooves, particularly at the groove intersections and most particularly at the central intersection where the yarn has a tendency to resist being guided away from the central location at which the yarn is fed to the drum. Obviously, when a yarn escapes from a groove or shifts from one groove to the other at an intersection, winding errors occur that can result in an imperfect cross-wound package, causing problems in subsequent processes in which the yarn is unwound from the package for further processing.

Various attempts have been made to improve the reliability of yarn traversing guiding by modifications of the configuration of the grooves. For example, German Patent Disclosure DE 40 10 470 A1 discloses grooves having a lobe-shaped cross-section for the purpose of retaining the yarn in the groove. However, this groove configuration does not significantly improve the yarn retention at groove intersections, particularly at the central intersection where the yarn tends to be close to the surface of the drum and tends to maintain a central position, resisting the outward guiding by the grooves.

The problem is less at groove intersections that are spaced from the center of the drum as relatively shallow groove sections can be utilized in guiding the yarn in the direction toward the center, which direction does not change tension at outwardly spaced intersections, and the deep groove sections reliably guiding the yarn traversing in the direction away from the center.

The problem is significantly more difficult at the central intersection of the grooves where there is little problem with a deep groove section in traversing in one direction, but there is a significant problem when the yarn is being traversed in the opposite direction in a shallower groove section. To alleviate the problem somewhat, relatively large yarn-capturing pockets are formed in the shallower groove, but even with such configurations there is a tendency at current conventional high winding speeds for the yarn to escape from the yarn-capturing pockets and be engaged in the opposite deep groove to be traversed back in the wrong direction.

SUMMARY OF THE INVENTION

By the present invention, a yarn traversing drum is provided that assures reliable traversing of the yarn, even at high winding speeds to wind uniform yarn packages. This is accomplished by forming the grooves at the central groove intersection with different depths. One groove is shallower and has a smaller angle of inclination at the central intersection than the deeper groove, such that when the yarn is being guided in the shallower groove the lesser angle of inclination reduces the tendency of the yarn to escape from the groove as it is being guided away from the center of the drum. The angle of inclination of the groove having the smaller angle of inclination is between 10° and 15° and in the preferred embodiment approximately 14°. On the other hand, the angle of inclination of the groove having the larger angle of inclination is between 16° and 20°, and in the preferred embodiment approximately 17°.

Preferably, the groove having the smaller angle of inclination is formed with a relatively shallow central section at the central intersection of the grooves, a deeper and wider intermediate section adjacent the central section in the direction of yarn guiding and forming a yarn-capturing pocket to engage and retain the yarn guided in the smaller inclination groove as the yarn is guided through the central intersection, and a relatively deep section extending from the intermediate section.

To further facilitate retention of the yarn in the grooves as the yarn is guided through the central intersection, the groove having the greater angle of inclination has a central section at the central intersection having an outwardly beveled side intersecting the yarn-capturing pocket of the smaller inclination groove.

Advantageously, the interconnecting yarn reversing ends of the grooves adjacent opposite ends of the drum are offset circumferentially approximately 90° to accommodate the difference of inclination of the grooves.

DETAILED DESCRIPTION OF THE PREFERRED EMBODIMENT

Figure 1:
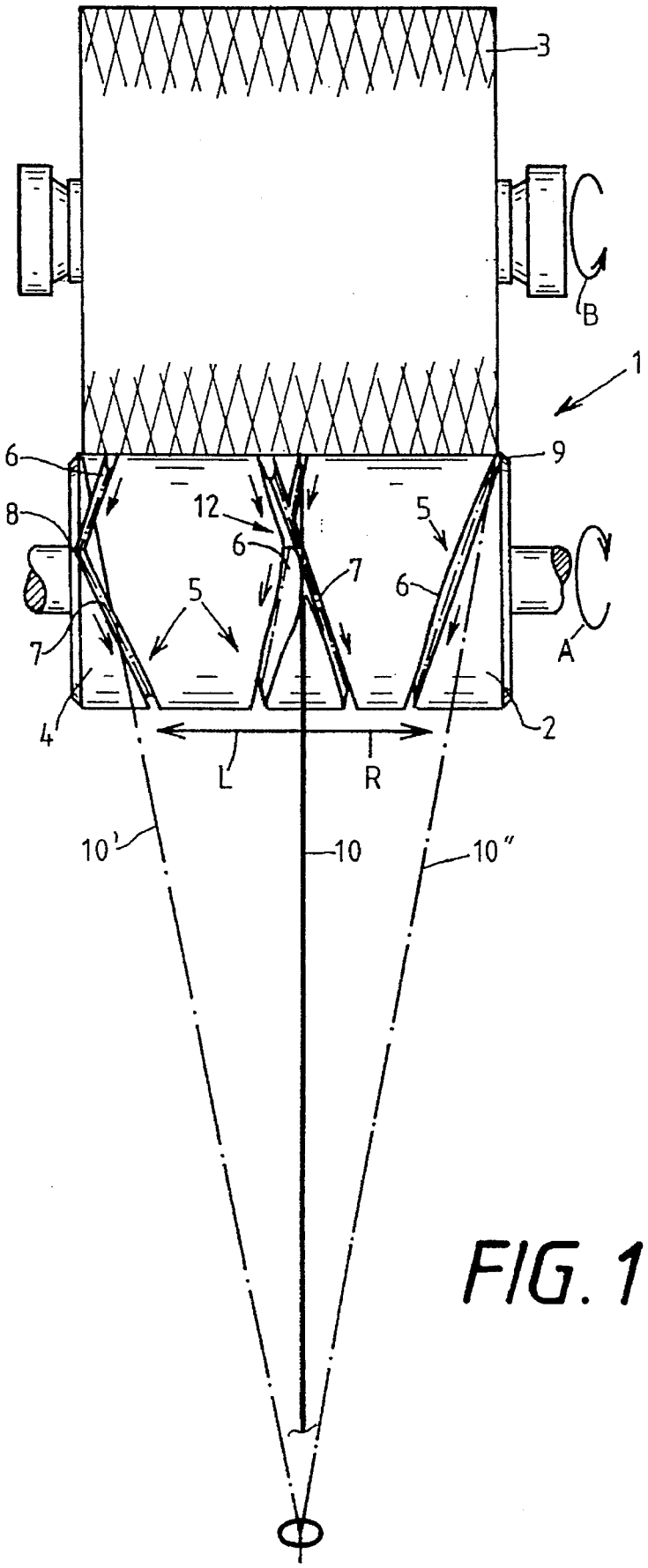
FIG. 1 is an elevational view of a yarn traversing drum of a yarn winding device incorporating the preferred embodiment of the present invention and illustrated in combination with a cross-wound package resting on and being wound by the rotating traversing drum from yarn being delivered from a source.

The yarn traversing drum 2 of the preferred embodiment of the present invention illustrated in the drawings is shown in FIG. 1 incorporated in a winding station 1 of a yarn winding device, such as a textile winder, in which yarn 10 from a central location is drawn by the rotation of the cross-wound package 3 of yarn, which package 3 is driven by rotation of the drum 2 on which the package rests. In this manner, rotation of the traversing drum 2 in the clockwise direction of the arrow A results in a driving rotation of the package 3 in the counterclockwise direction of the arrow B to wind the yarn 10 onto the package 3. Other details of the textile winder are not shown as they are conventional and this invention may be incorporated in any conventional textile winder or other yarn winding device.

The yarn traversing drum 2 is cylindrical and has a cylindrical circumferential surface 4 in which a compound yarn guiding groove 5 is formed. This compound groove 5 includes a first helical groove 6 that traverses the engaged yarn 10 to the left L during rotation of the traversing drum 2. As seen in FIG. 1, the yarn engaged at the right-hand end of the traversing drum 2 in the groove 6 is illustrated by the dash-dot line 10". As the traversing drum 2 rotates, the first groove traverses the yarn across the cylindrical surface 4 of the drum 2 to the left through the central position of the yarn 10 to the left-most position 10' at the left edge of the surface 4 of the drum 2.

The composite groove 5 includes a second groove 7 that extends helically about the surface 4 of the drum 2 in the opposite direction to the first groove 6 to guide the engaged yarn to the right R from the left edge of the drum 4 to the right edge of the drum 4. Adjacent the opposite edges of the drum 4, the two helical grooves 6,7 interconnect to form yarn reversing ends 8,9 for guiding the reversal of the traverse of the yarn 10.

As the first and second grooves 6,7 extend helically about the surface 4 of the drum 2 in opposite directions, they intersect. As seen in the cylindrical surface development illustration of FIG. 2, the grooves 6,7 intersect at three locations 11,12,13 about the circumference of the surface 4 of the drum 2. One of these intersections 12 is in the axially central area of the traversing drum surface 4. In the illustrated embodiment the central intersection 12 is along the centerline M of the drum 2 intermediate its ends. This is the more critical intersection in comparison with the other two outwardly spaced intersections 11,13 because at the centerline M the yarn reverses the direction in which it extends from the centerline M and there is a more pronounced risk of the yarn 10 escaping from the groove and entering the reversely extending groove without completing the traverse to the end of the drum 2.

To prevent the yarn 10 from escaping from the groove 7 that traverses the yarn to the right R, that groove is formed relatively narrow and relatively deep into the surface 4 of the drum 2 so that the yarn 10 is retained in the narrow, deep groove 7 with little or no likelihood of escape as it traverses the central intersection 12.

The other groove 6 is of a shallower depth, and to minimize the risk of escape of the yarn 10 as the yarn is being traversed in the shallower groove 6 through the central intersection 12, the angle of inclination $\alpha$ approaching, through and leaving the central intersection 12 is smaller with respect to the centerline M than the corresponding angle of inclination $\beta$ of the other groove 7. With this angle of inclination relationship, there is a considerably lesser possibility of yarn escape from the groove 6 during traversing of the central intersection 12.

Preferably, the smaller angle of inclination G of the shallower groove 6 at the central intersection 12 is between 10° and 15°, and, in the preferred embodiment, is approximately 14°. On the other hand, the larger angle of inclination $\beta$ of the deeper groove 7 at the central intersection 12 is preferably between 16° and 20°, and, in the preferred embodiment, is approximately 17°.

Further, the outer edge of the narrow, deep groove 7 at the central intersection 12 is beveled at 17 to further minimize reverse engagement of the yarn 10 into the groove 7 as it is traversing the central intersection 12 in the groove 6.

As a result, the yarn 10 remains reliably engaged in the shallower, wider groove 6 as it traverses the central intersection 12 and enters the yarn-capturing pocket 15 formed in the groove 6 beyond the central intersection 12.

In the preferred embodiment, the grooves 6,7 are formed generally uniformly helically around the surface 4 of the drum 2 and, because of the difference in the angles of inclination, the groove 6 has a lesser pitch and, therefore, has a longer circumferential length in traversing the length of the drum 2 than the groove 7. This results, in the illustrated embodiment, of the reversing ends 8,9 of the grooves 6,7 adjacent the outer ends of the drum surface 4 being approximately 90° offset circumferentially, or out of phase, from each other. As seen most clearly in FIG. 2, the outer end of the groove 7 adjacent the left end of the drum surface 4 and the outer end of the groove 6 at the right end of the drum surface 4 are of greater inclination than the remainder of the respective grooves to facilitate faster takeaway of the traversing yarn from the reversing ends 8,9 to better control the yarn buildup on the outer ends of the package 3.

Figure 2:
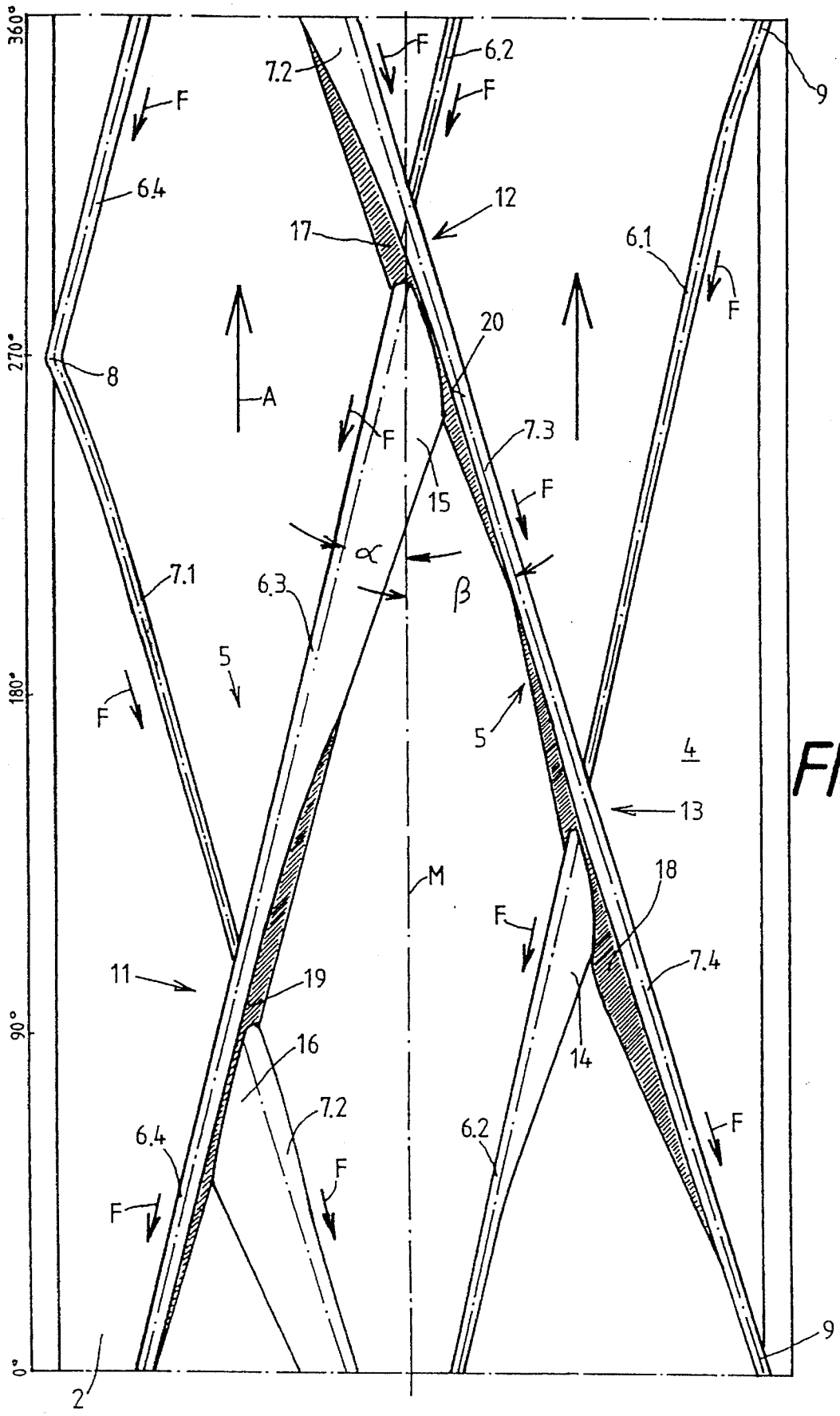
FIG. 2 is an enlarged development view of the circumferential surface of the traversing drum of FIG. 1.
Figure 3:
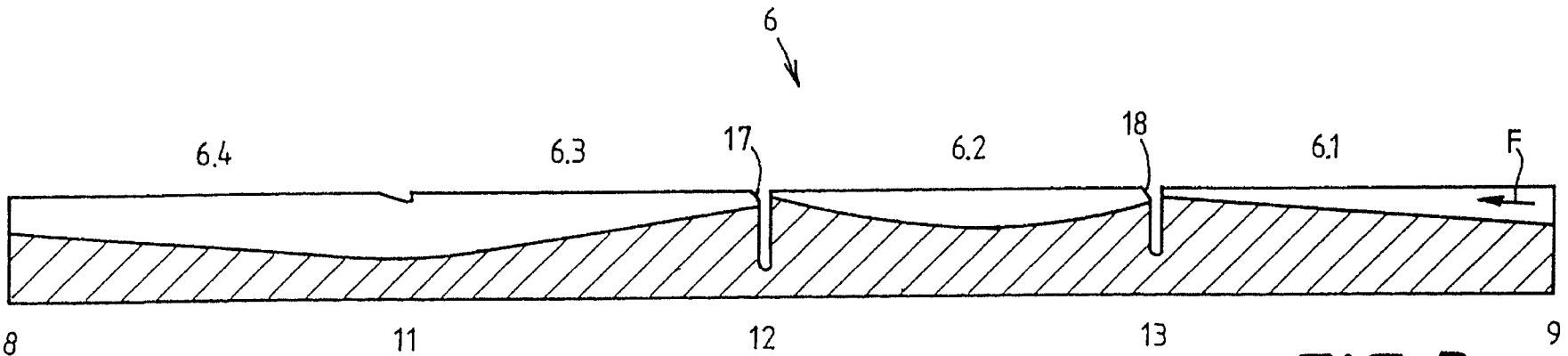
FIG. 3 is a longitudinal sectional view taken along the length of the groove of the traversing drum of FIG. 1 that has the lesser degree of inclination at the central intersection with the other groove.

Referring to FIGS. 2 and 3, the first groove 6 is shown to have a narrow groove section 6.1 as it extends from the reversing end 9 at the right of the drum surface 4 toward the right-hand intersection 13 of the grooves. This narrow groove section 6.1 has its greatest depth at the reversing end 9 and becomes relatively shallow as it extends toward the right-hand intersection 13. Extending from the right-hand intersection 13, the groove 6 is formed with a section 6.2 having an initial shallow yarn-capturing pocket 14, with the intersecting edge of the groove 7 having a bevel 18 similar to the bevel 17 at the central intersection 12 described above. The depth of the first groove 6 extending from the yarn-capturing pocket 14 increases to the generally average groove depth in the direction of the central intersection 12 and becomes shallow as it forms the central intersection 12 with the other groove 7. At and beyond the central intersection 12, the first groove 6 forms a large yarn-capturing pocket 15 and increases in depth as it extends away from the central intersection 12. The aforementioned bevel 17 extends into the yarn engaging edge 20 to facilitate yarn retention in the groove 6.

At the left-hand intersection 11, the groove section 6.3 extends to its greatest depth. Beyond the left-hand intersection 11, the groove 6 has a section 6.4 that becomes shallower to a central level at the reversing end 8.

With this configuration, the first groove 6 engages the yarn 10' as the yarn leaves the other groove 7 at the reversing end 9 and guides the yarn across the surface 4 of the drum 2 to the left, first, guiding it in the section 6.1 from a greatest depth to the relatively shallow depth at the right-hand intersection 13, into the yarn-capturing pocket 14 in the section 6.2. Then, the yarn is guided through the section 6.2 to a deeper depth and then to a shallower depth at the central intersection 12. As the yarn is guided through the central intersection 12, it is engaged in the yarn-capturing pocket 15 in the section 6.3 and is guided therein to a deepest depth at the left-hand intersection 11, from which the yarn is guided in the section 6.4 to a lesser average depth at the reversing end 8.

Figure 4:
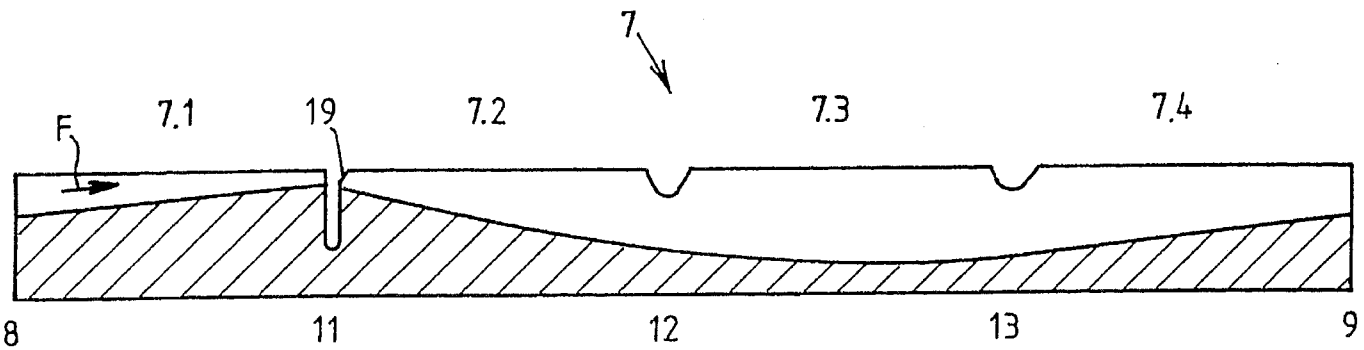
FIG. 4 is a longitudinal sectional view through the groove of the traversing drum of FIG. 1 having a greater angle of inclination at the intersection with the groove of FIG. 3 at the central intersection.

Referring to FIGS. 2 and 4, the second groove 7 is formed with a narrow groove section 7.1 extending from the reversing end 8 at the left of the drum surface 4. This section 7.1 rises from an average depth at the reversing end 8 toward the left-hand intersection 11, beyond which the groove 7 is formed with a section 7.2 having a yarn-capturing pocket 16 and the groove 6 is formed with a beveled edge 19 of the type described above. Extending from the left-hand intersection 11, the groove section 7.2 becomes narrower and deeper through the central intersection 12 and continues therefrom as a section 7.3 through the right-hand intersection 13, from which the groove 7 extends as a section 7.4 that becomes shallower to the average groove depth at the reversing end 9 at the right of the drum 2, which depth is the same as the depth of the end of the other groove 6 at the right-hand reversing end 9.

With this configuration of the groove 7, the yarn is traversed in the groove 7 from the left-hand reversing end 8 to the right-hand reversing end 9 in a groove configuration that is complimentary to the configuration of the other groove 6 and includes a deep guide groove configuration at the critical central intersection 12.

With the foregoing groove configuration, the present invention provides a significantly improved winding operation that functions reliably to avoid winding errors and imperfections from yarn escaping from the grooves, particularly at the central intersection.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A yarn traversing drum for a yarn winding device, comprising:

a cylindrical surface having two generally helical yarn traversing guide grooves formed therein and interconnecting at reversing ends of the grooves adjacent outer ends of the traversing drum surface for guiding the reversal of traverse of the yarn;

said cylindrical surface having an axially central area intermediate said outer ends of said surface;

said grooves intersecting in the axially central area of the traversing drum surface to form a central intersection;

said grooves having different angles of inclination at the central intersection with respect to a line perpendicular to and in the center of the axial length of said drum; and the one of said two grooves having the smaller angle of inclination at the central intersection having a shallower groove depth at the central intersection than the groove with the larger angle of inclination.

2. A yarn traversing drum according to claim 1, wherein said groove having the smaller angle of inclination at the central intersection has an angle of inclination thereat between 10° and 15°.

3. A yarn traversing drum according to claim 1, wherein said groove having the smaller angle of inclination at the central intersection has an angle of inclination of approximately 14°.

4. A yarn traversing drum according to claim 1, wherein said groove having the larger angle of inclination at the central intersection has an angle of inclination between 16° and 20°.

5. A yarn traversing drum according to claim 1, wherein said groove having the larger angle of inclination at the central intersection has an angle of approximately 17°.

6. A yarn traversing drum according to claim 1, wherein said groove having the smaller angle of inclination at the central intersection has an angle of inclination thereat between 10° and 15° and said groove having the larger angle of inclination at the central intersection has an angle of inclination between 16° and

7. A yarn traversing drum according to claim 1, wherein said groove having the smaller angle of inclination at the central intersection has an angle of inclination of approximately 14° and said groove having the larger angle of inclination at the central intersection has an angle of approximately 17° .

8. A yarn traversing drum according to claim 1, wherein said yarn is guided through said grooves in a yarn guiding direction, and said groove having the smaller angle of inclination has a relatively shallow central section at the central intersection, a deeper and wider intermediate section adjacent the central intersection and downstream therefrom in the yarn guiding direction to engage and retain the guided yarn in said smaller inclination groove as the yarn is guided through the central intersection, and a relatively deep section extending from said intermediate section.

9. A yarn traversing drum according to claim 8, wherein said groove having the greater angle of inclination has at the central intersection a beveled edge intersecting the yarn-capturing pocket of the smaller inclination groove.

10. A yarn traversing drum according to claim 1, wherein the interconnecting yarn reversing ends of the grooves adjacent opposite ends of the drum are offset circumferentially approximately 90° to accommodate the difference in inclination of the grooves.

* * * * *